US006201356B1

(12) United States Patent
Ushijima et al.

(10) Patent No.: US 6,201,356 B1
(45) Date of Patent: Mar. 13, 2001

(54) CONVERTER FOR CORRECTING RESONANCE FREQUENCY BETWEEN BACKLIT PANEL ASSEMBLY OF LIQUID CRYSTAL DISPLAY AND TRANSFORMER OF AC INVERTER

(76) Inventors: Masakazu Ushijima, 6-30-24 Nokata, Nakano Ward, Tokyo Metropolis (JP); Chen-Yong Chang, 3F., No. 2, Lane 110, Chien-Ming RD., Taipei City (TW)

( * ) Notice: Subject to any disclaimer, the term of this patent is extended or adjusted under 35 U.S.C. 154(b) by 0 days.

(21) Appl. No.: 09/425,133

(22) Filed: Oct. 21, 1999

(51) Int. Cl.[7] ..... H05B 41/16

(52) U.S. Cl. ..... 315/282; 315/169.3; 315/173; 315/276; 315/DIG. 7; 439/620

(58) Field of Search ..... 315/173, 188, 315/184, 282, 227, 229, 231, 232, 241 R, 243, 244, 246, 276, DIG. 7, 169.3; 439/34, 36, 365, 366, 620

(56) References Cited

U.S. PATENT DOCUMENTS

| | | | | |
|---|---|---|---|---|
| 5,495,405 | * | 2/1996 | Fujimura et al. | 363/133 |
| 5,767,630 | * | 6/1998 | Williams | 315/282 |
| 5,973,437 | * | 10/1999 | Gradzki et al. | 310/307 |
| 6,011,360 | * | 1/2000 | Gradzki et al. | 315/244 |

* cited by examiner

*Primary Examiner*—Don Wong
*Assistant Examiner*—Tuyet T. Vo
(74) *Attorney, Agent, or Firm*—Pro-Techtor International Services

(57) ABSTRACT

The specification discloses a converter for correcting the resonance frequency between the backlit panel assembly of a liquid crystal display and the transformer of an AC inverter. The convert has on its both ends a first connector for plugging in a discharge tube connector and a second connector for plugging in a transformer circuit output connector of the AC inverter. In the middle, a parasitic capacitor correction apparatus connects both connectors to correct the parasitic capacity of the discharge tube. Therefore, the present invention can be applied to any liquid crystal display without employing any extra transformer circuit for the AC inverter. The price of it can be lowered by mass production.

5 Claims, 3 Drawing Sheets

CONVERTER FOR CORRECTING RESONANCE FREQUENCY BETWEEN BACKLIT PANEL ASSEMBLY OF LIQUID CRYSTAL DISPLAY AND TRANSFORMER OF AC INVERTER

BACKGROUND OF THE INVENTION

1. Field of Invention

The invention relates to a structure of a converter for correcting the resonance frequency between the backlit panel assembly of a liquid crystal display and an transformer of an AC inverter, which corrects the parasitic capacitor to increase the whole efficiency of the AC inverter under the premise of not changing the transformer of the AC inverter, and, more particularly, to a converter which has on its both ends a first connector for plugging in a discharge tube connector and a second connector for plugging in a transformer circuit output connector, and in the middle a correction capacitor for correcting the parasitic capacity of the discharge tube.

2. Related Art

The transformer for driving discharge tubes such as the cold cathode florescent lamp, hot cathode florescent lamp, mercury lamp, sodium lamp, metal halide lamp, neon lamp, etc has been issued the R.O.C. patent with the U.S. Pat. No. 334,666. The main action of this invention is to have the best working resonance frequency between the ionized inductance on both sides of the AC inverter transformer of the discharge tube and the cold cathode tube of the backlit panel. Therefore, even though the voltage raising transformer is minimized to increase the driving frequency, the luminosity of the discharge tube will not get lowered. However, this type of transformer circuit for the AC inverter has a big defect; that is, it has to be designed case by case according to the individual liquid crystal display, thus the price of the product is relatively high.

Please refer to FIG. 1, which is an explosion view of the local structure of a conventional liquid crystal display. As shown in the figure, the liquid crystal display is composed of a liquid crystal panel 1 and a backlit panel 2. The light source is provided by a discharge tube, such as a cold cathode tube, positioned by the side of the backlit panel 2. To enhance the utility efficiency of the light, a thermal conducting reflection panel 4 similar to a silver plated pet film is provided on the outer side of the discharge tube 3. Conventional technology of connecting the discharge tube 3 with the transformer circuit of the AC inverter is to directly connect the connector 31 of the discharge tube 3 to the output connector of the transformer circuit.

When a liquid crystal display is used, the discharge tube 3 (taking a cold cathode tube as an example) is lit up to make the backlit panel 2 reflect light. The gas inside the cold cathode tube is ionized into ions and lights up the cold cathode tube. The backlit panel 2 is thus reflecting light therefrom. Since ions are good conductors of electricity, they and the cold cathode tube glass form a capacitor in the reflection panel 4 (silver film) with the air as the dielectric. This is called the parasitic capacitor. The value of the parasitic capacity varies with the material combination of the backlit panel 2 and the reflection panel 4. Although the transformer circuit of the cold cathode tube uses a voltage raising transformer, yet the inductance magnitude of this transformer and the parasitic capacity when the lamp is on have a very larger impact on the whole efficiency of the AC inverter working under assigned frequencies.

In general, the parasitic capacity is influenced by the following factors:

1. When the assembly method of the backlit panel 2 is different, the parasitic capacity surrounding the discharge tube 3 (cold cathode tube) in the liquid crystal display will generate different effects according to different liquid crystal displays.
2. The parasitic capacity is also different for different sizes of the liquid crystal display.
3. The value of the parasitic capacity also differs for different types of the discharge tube 3 (cold cathode tube) used in the liquid crystal display.

From the above factors that affect the parasitic capacity, even the liquid crystal displays of the same size will have different states of the surrounding parasitic capacity for the discharge tube 3 of the liquid crystal displays according to different manufacturers and series products. This result will make the retailers obtain the liquid crystal displays via multiple ways because of unstable liquid crystal display supply. The transformer circuit has to fit various liquid crystal display designs. Therefore, not only is the cost increased, the price of the transformer circuit is also getting higher.

In view of the foregoing fact that the parasitic capacity changes under various influences, this will in turn result in the defect that the assembly of the transformer circuit of the AC inverter and the best working frequency of the discharge tube 3 has to fit individual liquid crystal display design. This indeed influences the manufacturing cost of the transformer circuit of the AC inverter and increases the price. The inventor then made every effort in research and, with accumulated experience in the industry, came up with a converter for correcting the resonance frequency between the discharge tube of a liquid crystal display and the transformer of an AC inverter. The convert has on its both ends a first connector for plugging in a discharge tube connector and a second connector for plugging in a transformer circuit output connector of an AC inverter. In the middle, a parasitic capacitor correction apparatus connects both connectors to correct the parasitic capacity of the discharge tube. Therefore, a single AC inverter can be applied to a liquid crystal display of any brand without employing any special transformer circuit for the AC inverter. The price of it can be lowered by mass production.

SUMMARY OF THE INVENTION

Therefore, a main object of the present invention is to provide a converter for correcting the resonance frequency between the discharge tube of a liquid crystal display and the transformer of an AC inverter. The convert has on its both ends a first connector for plugging in a discharge tube connector and a second connector for plugging in a transformer circuit output connector of an AC inverter. In the middle, a parasitic capacitor correction apparatus connects both connectors to correct the parasitic capacity of the discharge tube. Therefore, the converter can be applied to any liquid crystal display.

To achieve the above object, the instant invention is a converter for correcting the resonance frequency between the discharge tube of a liquid crystal display and the transformer of an AC inverter, which converter is placed between the connector of the liquid crystal display discharge tube and the output connector of the transformer circuit. The characteristic of the invention is: one end of the converter is a first connector for plugging in the discharge tube connector, while the other end is a second connector for plugging in the transformer circuit output connector of an AC inverter. The middle of the converter is a parasitic capacity correction apparatus that connects said first connector and said second connector.

In particular, the parasitic capacity correction apparatus of the converter can be a set of capacitors in series that connect to said first connector and said second connector; a set of inductors in series that connect to said first connector and said second connector; a set of capacitors and inductors in series that connect to said first connector and said second connector; and all shape coupling circuit composed of a serial or parallel combination of capacitors and inductors that connects to said first connector and said second connector.

The method employed in the previous converter structure corrects the parasitic capacity of the liquid crystal display to unify the surrounding parasitic capacity of the backlit panel of various kinds or from different sources. After connecting the discharge tube of the liquid crystal display backlit panel to the correction capacitor, the connecting terminal of the parasitic capacitor can keep the luminosity of the backlit panel within the specific range when the liquid crystal display is on. Therefore, only a single transformer circuit of the AC inverter is sufficient in applying to any liquid crystal display.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
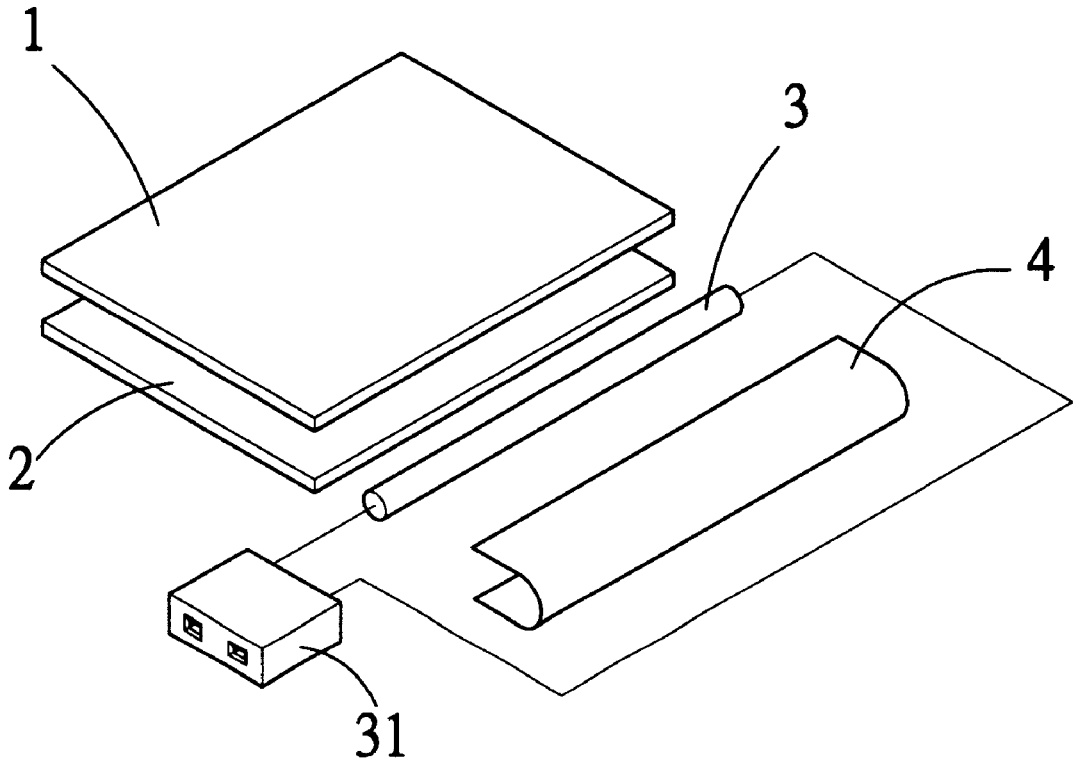
(PRIOR ART) Fig.1
FIG. 1 is an explosion view of the local structure of a conventional liquid crystal display.
Figure 2:
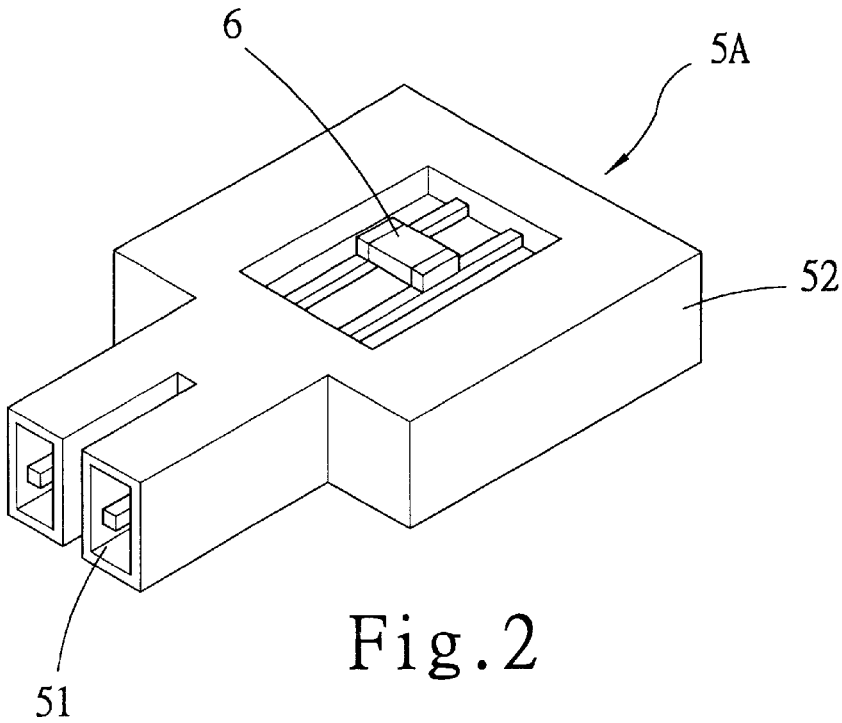
FIG. 2 is the first embodiment of the present invention.

Please refer to FIG. 2, which is the first embodiment of the present invention. The converter 5A for correcting the resonance frequency between a backlit panel assembly of a liquid crystal display and a transformer of an AC inverter is provided between the discharge tube connector of the liquid crystal display and the transformer output connector of the AC converter. One end of the converter 5A provides a first connector 51 for the discharge tube connector; the other end provides a second connector 52 for the transformer output connector of the AC inverter. A parasitic capacitor correction apparatus composed of capacitors in parallel 6 is provided in the middle connecting the first connector 51 and the second connector 52.

Figure 3:
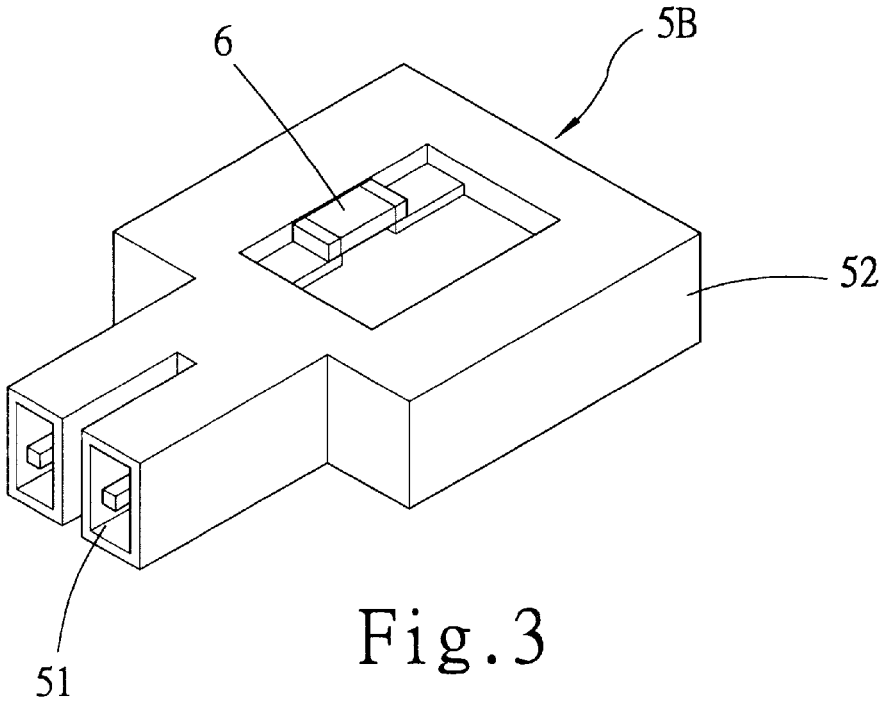
FIG. 3 is the second embodiment of the present invention.

Please refer to FIG. 3, which is the second embodiment of the present invention. The converter 5B for correcting the resonance frequency between a backlit panel assembly of a liquid crystal display and a transformer of an AC inverter is provided between the discharge tube connector of the liquid crystal display and the transformer output connector of the AC inverter. One end of the converter 5B provides a first connector 51 for the discharge tube connector; the other end provides a second connector 52 for the transformer output connector of the AC inverter. A parasitic capacitor correction apparatus composed of capacitors in series 6 is provided in the middle connecting the first connector 51 and the second connector 52.

Figure 4:
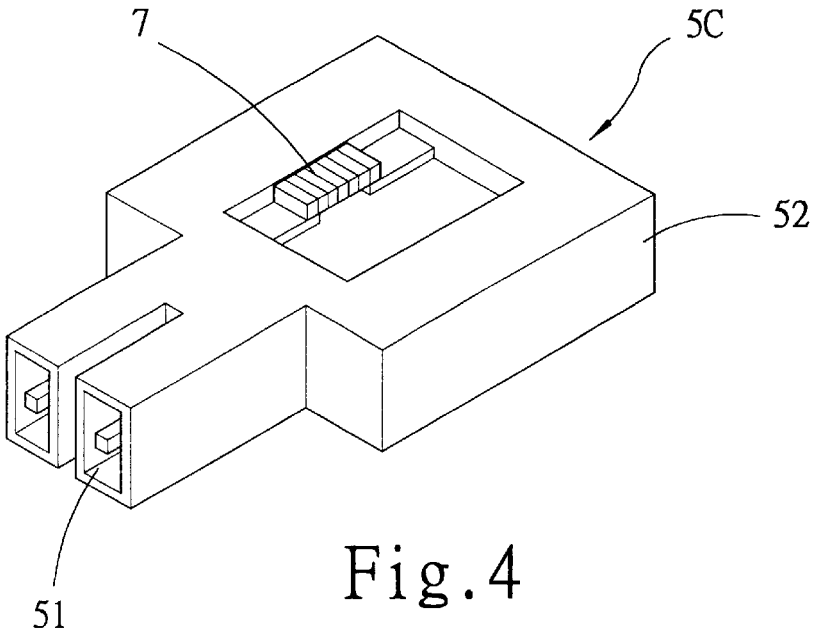
FIG. 4 is the third embodiment of the present invention.

Please refer to FIG. 4, which is the third embodiment of the present invention. The converter 5C for correcting the resonance frequency between a backlit panel assembly of a liquid crystal display and a transformer of an AC inverter is provided between the discharge tube connector of the liquid crystal display and the transformer output connector of the AC inverter. One end of the converter 5C provides a first connector 51 for the discharge tube connector; the other end provides a second connector 52 for the transformer output connector of the AC inverter. A parasitic capacitor correction apparatus composed of inductors in series 7 is provided in the middle connecting the first connector 51 and the second connector 52.

Figure 5:
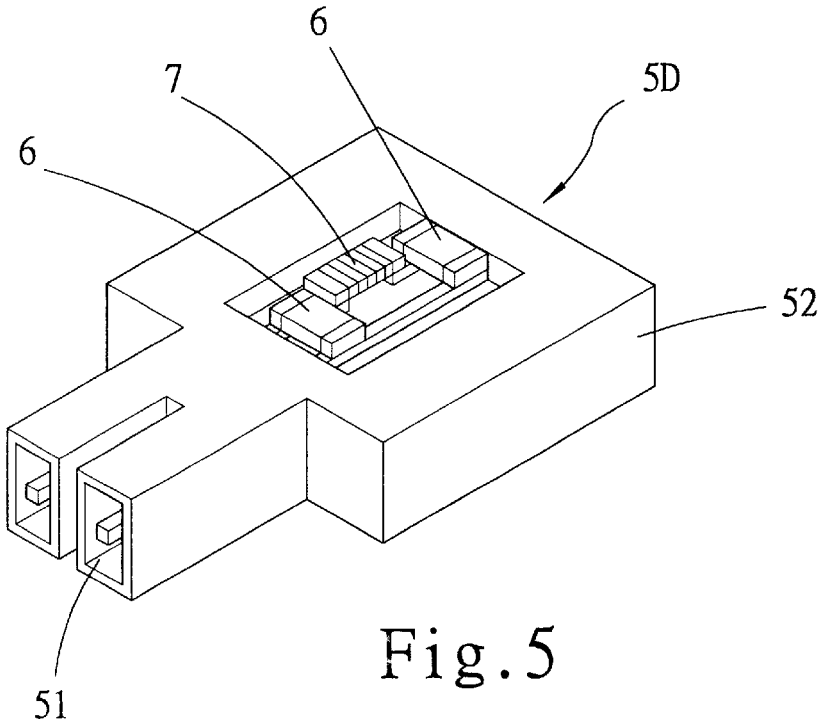
FIG. 5 is the fourth embodiment of the present invention.

Please refer to FIG. 5, which is the fourth embodiment of the present invention. The converter 5D for correcting the resonance frequency between a backlit panel assembly of a liquid crystal display and a transformer of an AC inverter is provided between the discharge tube connector of the liquid crystal display and the transformer output connector of the AC inverter. One end of the converter 5D provides a first connector 51 for the discharge tube connector; the other end provides a second connector 52 for the transformer output connector of the AC inverter. A parasitic capacitor correction apparatus is a Π shape coupling circuit composed of a serial or parallel combination of capacitors and inductors 6,7 that connects to the first connector 51 and the second connector 52.

By applying the special structure of the above mentioned invention between the discharge tube and the AC inverter transformer circuit, the parasitic capacity surrounding the discharge tube can be corrected. The corrected connecting terminal of the parasitic capacitor can keep the luminosity of the backlit panel within specific range when the liquid crystal display is on. Only a single transformer circuit of the AC inverter can be applied to liquid crystal display of any brand. Therefore, the AC inverter transformer circuit of all liquid crystal displays can have a converter with a unique specification that applies to all sorts of liquid crystal displays without employing any special AC inverter transformer circuit. Accordingly, the price can be lowered by mass production. This technology is novel and have great utility and progress than the prior art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A converter for correcting the resonance frequency between a backlit panel assembly of a liquid crystal display and a transformer of an AC inverter, comprising:

a first connector provided on a first end of said converter, said first connector receiving a discharge tube, a second connector provided on a second end of said converter, said second connector serving as a connector for said transformer of said AC inverter, and a parasitic capacitor correction means provided in a middle portion of said converter between said first connector and said second connector.

2. The converter for correcting the resonance frequency between a backlit panel assembly of a liquid crystal display and a transformer of an AC inverter of claim 1, wherein said parasitic capacity correction apparatus is a set of capacitors in parallel that connect to said first connector and said second connector.

3. The converter for correcting the resonance frequency between a backlit panel assembly of a liquid crystal display and a transformer of an AC inverter of claim 1, wherein said parasitic capacity correction apparatus is a set of capacitors in series that connect to said first connector and said second connector.

4. The converter for correcting the resonance frequency between a backlit panel assembly of a liquid crystal display and a transformer of an AC inverter of claim 1, wherein said parasitic capacity correction apparatus is a set of inductors in series that connect to said first connector and said second connector.

5. The converter for correcting the resonance frequency between a backlit panel assembly of a liquid crystal display and a transformer of an AC inverter of claim 1, wherein said parasitic capacity correction apparatus is a Π shape coupling circuit composed of a serial or parallel combination of capacitors and inductors that connects to said first connector and said second connector.

* * * * *